US011351607B2

(12) United States Patent
Gnutti et al.

(10) Patent No.: US 11,351,607 B2
(45) Date of Patent: Jun. 7, 2022

(54) METHOD FOR MANUFACTURING A LEAD-FREE OR LOW LEAD CONTENT BASS BILLET AND BILLET THUS OBTAINED

(71) Applicant: ALMAG S.p.A., Brescia (IT)

(72) Inventors: Gabriele Gnutti, Brescia (IT); Marco Bertelli, Brescia (IT)

(73) Assignee: ALMAG S.p.A., Brescia (IT)

( * ) Notice: Subject to any disclaimer, the term of this patent is extended or adjusted under 35 U.S.C. 154(b) by 274 days.

(21) Appl. No.: 16/302,494

(22) PCT Filed: May 12, 2017

(86) PCT No.: PCT/IB2017/052806
§ 371 (c)(1),
(2) Date: Nov. 16, 2018

(87) PCT Pub. No.: WO2017/199147
PCT Pub. Date: Nov. 23, 2017

(65) Prior Publication Data

US 2019/0299295 A1 Oct. 3, 2019

(30) Foreign Application Priority Data

May 18, 2016 (IT) ..... 102016000051168

(51) Int. Cl.
*B22F 3/20* (2006.01)
*B22F 9/04* (2006.01)
(Continued)

(52) U.S. Cl.
CPC ..... *B22F 3/20* (2013.01); *B22F 9/04* (2013.01); *B22F 9/10* (2013.01); *B22F 9/16* (2013.01);
(Continued)

(58) Field of Classification Search
CPC ..... B22F 3/20; B22F 9/04; B22F 9/10; B22F 9/16; B22F 2003/208; B22F 2009/046;
(Continued)

(56) References Cited

U.S. PATENT DOCUMENTS 2,920,760 A * 1/1960 Genders ..... B21C 23/035 72/259
2009/0092517 A1* 4/2009 Kosaka ..... C22C 1/0425 420/471
2011/0056591 A1 3/2011 Kondoh et al.

FOREIGN PATENT DOCUMENTS

CN 102016089 A 4/2011
CN 102828064 A 12/2012
(Continued)

OTHER PUBLICATIONS

Pemsler et al. ("A Survey of Metallurgical Recycling Processes". EIC Corporation. Mar. 1979.) (Year: 1979).*
(Continued)

*Primary Examiner* — Anthony J Zimmer
*Assistant Examiner* — Ricardo D Morales
(74) *Attorney, Agent, or Firm* — Merchant & Gould P.C.

(57) ABSTRACT

A method for obtaining a lead-free or low lead content brass billet subjects a mixture of lead-free or low lead content brass chips and graphite powder to extrusion, either direct or inverted. The method obtains lead-free or low lead content brass billets.

7 Claims, 3 Drawing Sheets

(51) Int. Cl.

| | |
|---|---|
| ***B22F 9/10*** | (2006.01) |
| ***B22F 9/16*** | (2006.01) |
| ***C22C 1/05*** | (2006.01) |
| ***C22C 9/04*** | (2006.01) |
| ***C22C 32/00*** | (2006.01) |
| ***B22F 9/08*** | (2006.01) |

(52) U.S. Cl.
CPC ..... *C22C 1/05* (2013.01); *C22C 9/04* (2013.01); *C22C 32/0084* (2013.01); *B22F 2003/208* (2013.01); *B22F 2009/046* (2013.01); *B22F 2009/0828* (2013.01); *B22F 2201/10* (2013.01); *B22F 2201/20* (2013.01); *B22F 2998/10* (2013.01); *B22F 2999/00* (2013.01)

(58) Field of Classification Search
CPC ..... B22F 2009/0828; B22F 2201/10; B22F 2201/20; B22F 2998/10; B22F 2999/00; C22C 1/05; C22C 9/04; C22C 32/0084
See application file for complete search history.

(56) References Cited

FOREIGN PATENT DOCUMENTS

| | | | |
|---|---|---|---|
| CN | 105435790 | A | 3/2016 |
| EP | 2 275 582 | A1 | 1/2011 |
| IT | BS2013A000119 | A1 | 2/2015 |
| JP | S50-133103 | A | 10/1975 |
| JP | S53-70901 | A | 6/1978 |
| JP | H02-502836 | A | 9/1990 |
| JP | H02-259002 | A | 10/1990 |
| JP | H04-88137 | A | 3/1992 |
| JP | H06-200340 | A | 7/1994 |
| JP | 2001-089818 | A | 4/2001 |
| JP | 2009-095878 | A | 5/2009 |
| JP | 2010-540769 | A | 12/2010 |
| JP | 2016-534233 | A | 11/2016 |
| JP | 2019-504191 | A | 2/2019 |
| RU | 2 103 286 | C1 | 1/1998 |

OTHER PUBLICATIONS

Chinese Office Action for corresponding Chinese Patent Application No. 201780029663.8 dated Apr. 28, 2020, 8 pages.
Russian Office Action for corresponding Russian Patent Application No. 2018144658/02(074514) dated May 15, 2020, 2 pages.
International Search Report and Written Opinion of the International Searching Authority for International Patent Application No. PCT/IB2017/052806 dated Jul. 18, 2017, 9 pages.
Imai, H. et al., "Characteristics and machinability of lead-free P/M Cu60-Zn40 brass alloys dispersed with graphite", Powder Technology, 198(3): 417-421 (2010).
Japanese Office Action for corresponding Japanese Patent Application No. 2019-513495 dated Nov. 24, 2020, 11 pages.
Japanese Office Action for Japanese Patent Application No. 2019-513495 dated Jun. 8, 2021, 6 pages.

* cited by examiner

METHOD FOR MANUFACTURING A LEAD-FREE OR LOW LEAD CONTENT BASS BILLET AND BILLET THUS OBTAINED

This application is a National Stage Application of PCT/IB2017/052806, filed 12 May 2017, which claims the benefit of Ser. No. 102016000051168, filed 18 May 2016 in Italy, and which applications are incorporated herein by reference. To the extent appropriate, a claim of priority is made to each of the above-disclosed applications.

BACKGROUND OF THE INVENTION

The present invention relates to a process for obtaining a brass billet and to a brass billet thus obtained. In particular, the present invention relates to a lead-free or low lead content brass billet.

In particular, brass is conventionally defined "lead-free" if the lead content is lower than 0.1% by weight; it is defined "low lead content" if the lead content is comprised between 0.1% and 0.2% by weight.

As known, brass, alloy of copper (Cu) and zinc (Zn), is a material widely used in the manufacturing industry, above all by virtue of its excellent castability, which allows to obtain semi-finished castings by means of casing processes, and the excellent machinability, which allows to finish the semi-finished product appropriately by means of chipping machining.

The machinability of brass strongly depends on the amount of lead (Pb) it contains.

However, the need to make some artifacts, e.g. faucets or other components in contact with water, particularly drinking water, with lead-free alloys has arisen in recent years. Mainly, such requirement springs from the need to prevent the lead from dissolving in water, with consequences deemed negative for health.

The research and development efforts of very many manufacturers thus address the definition of lead-free brass, which has mechanical and machinability features similar to those of traditional brass.

SUMMARY OF THE INVENTION

In this direction, one of the most promising addresses is the replacement of lead with graphite. With this regard, the Applicant is the owner of Italian patent application for invention No. 10 2013 9021 8136 5.

The present invention is part of this context, and in particular relates to an innovative process for manufacturing lead-free or low lead content brass billets and to the billet thus obtained.

BRIEF DESCRIPTION OF THE DRAWINGS

The features and the advantages of the process according to the present invention will be apparent from the description shown below.

DETAILED DESCRIPTION OF THE PREFERRED EMBODIMENT

Figure 1:
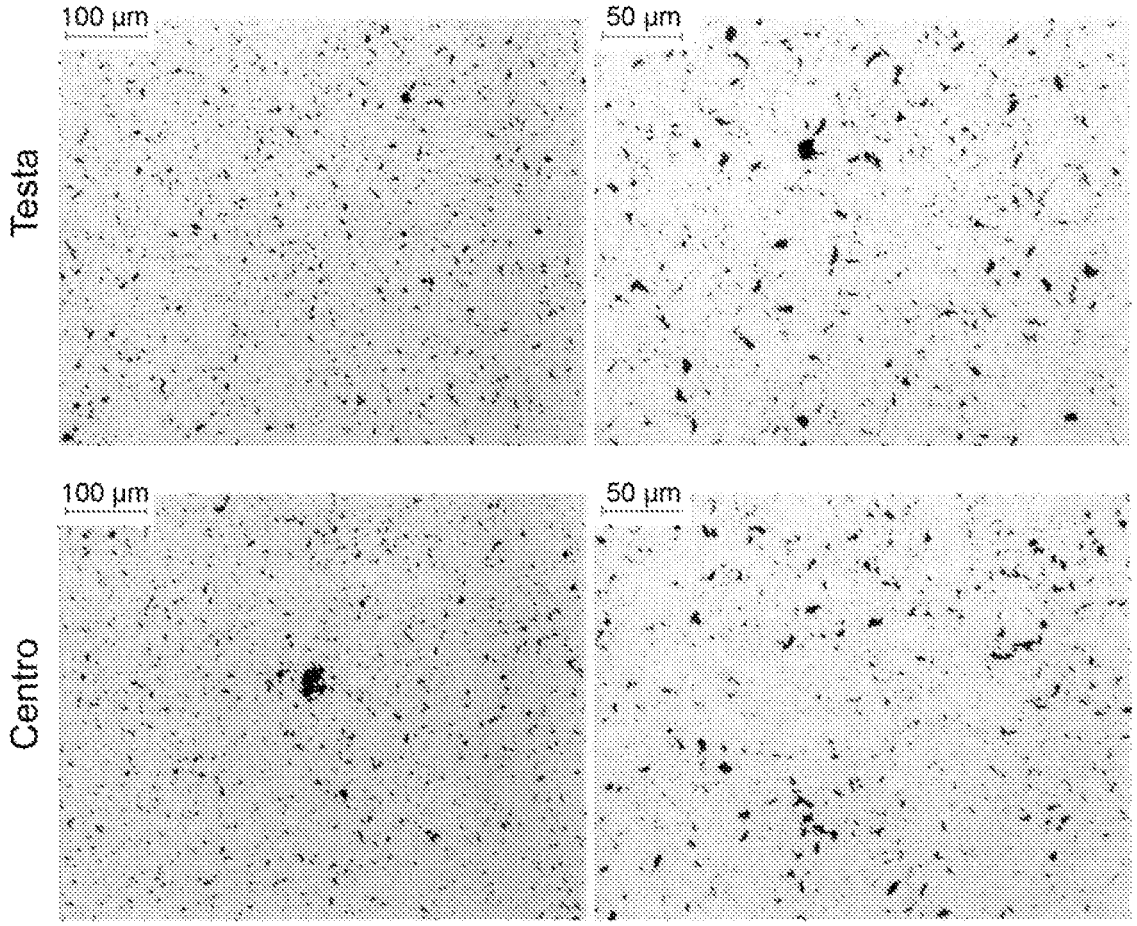
FIGS. 1 and 2 show microstructures, at two different enlargements, of lead-free brass bars according to the present invention, characterized in head and center, in cross section.

According to a process, the billet is obtained by extrusion, either direct or inverted, of a powder comprising brass powder and graphite powder.

The extrusion is performed in temperature conditions such to achieve a sintering of the powders and at a predetermined advancement speed of the punch, e.g. 120 millimeters/second.

For example, before performing the extrusion, the mixed powder is preheated to a preheating temperature, preferably lower than the melting temperature, for a predetermined interval of time. For example, the mixed powder is preheated to 720° C. for 1 hour.

The brass powder is substantially a lead-free or has low lead content; furthermore, the graphite powder is preferably joined in measure between 0.5%-2% by weight with respect to the brass powder, preferably about 1%.

According to a variant embodiment, the brass powder is obtained by means of splat cooling, melt-spinning, atomization process, by means of chemical reactions, such as precipitation, or by means of mechanical processes, such as grinding.

In particular, the atomization process can be performed as gas atomization, vacuum or inert atmosphere gas atomization, water atomization, centrifuge atomization, revolving disc atomization, by ultra-rapid solidification, ultrasonic atomization.

Preferably, the brass powder has a wide grain size range, e.g. between 500 μm and 50 μm; such a wide range, and possibly the irregular shape of the grain size, promotes the compacting of the powders.

Furthermore, according to a variant embodiment, the graphite powder is obtained by grinding.

The brass powder and the graphite powder are mixed, e.g. in a mixer/batcher, for a predetermined interval of time.

According to a variant embodiment, the mixed powder is collected in cylindrical containers, named cans, e.g. made of copper, which after having been filled and inert gas having been blown inside them, are hermetically closed, e.g. by welding.

For example, the inert gas used is Argon (Ar).

The containers are loaded into the extrusion machine and after preheating or during a heating, the extrusion, either direct or inverted, is performed, thus obtaining a composite billet, which contains the material of the container, e.g. on the surface.

Successively, a peeling operation for eliminating the material of the container of the composite billet is performed, thus obtaining the desired billet.

According to a further variant embodiment, the extrusion press is directly loaded with the mixed powder, directly obtaining the desired billet; this avoids the peeling process.

According to a yet further variant embodiment, the mixed powder, before sintering, is pressed, e.g. either in the container or directly in the extrusion press.

Experimental Tests

For example, in an experimental test:

- a first can C1, of diameter of about 70 millimeters, was prepared containing mixed lead-free brass and graphite powder, precompacted to 120 tonnes; and
- a second can C2, of diameter of about 70 millimeters, containing mixed lead-free brass and graphite powder, not compacted.

Preheating to 720° C. for 1 hour was performed on both cans C1, C2; the two cans C1, C2 were then subjected to direct extrusion, with extrusion ratio 8:1, punch speed 12 millimeters/second and final diameter of the billet of 30 millimeters.

Two bars were obtained: bar B1 from can C1 and bar B2 from can C2.

For both bars, the final density was about 8 grams/cm$^3$ and a hardness $HV_{5Kg}$ of about 85.

Figure 2:
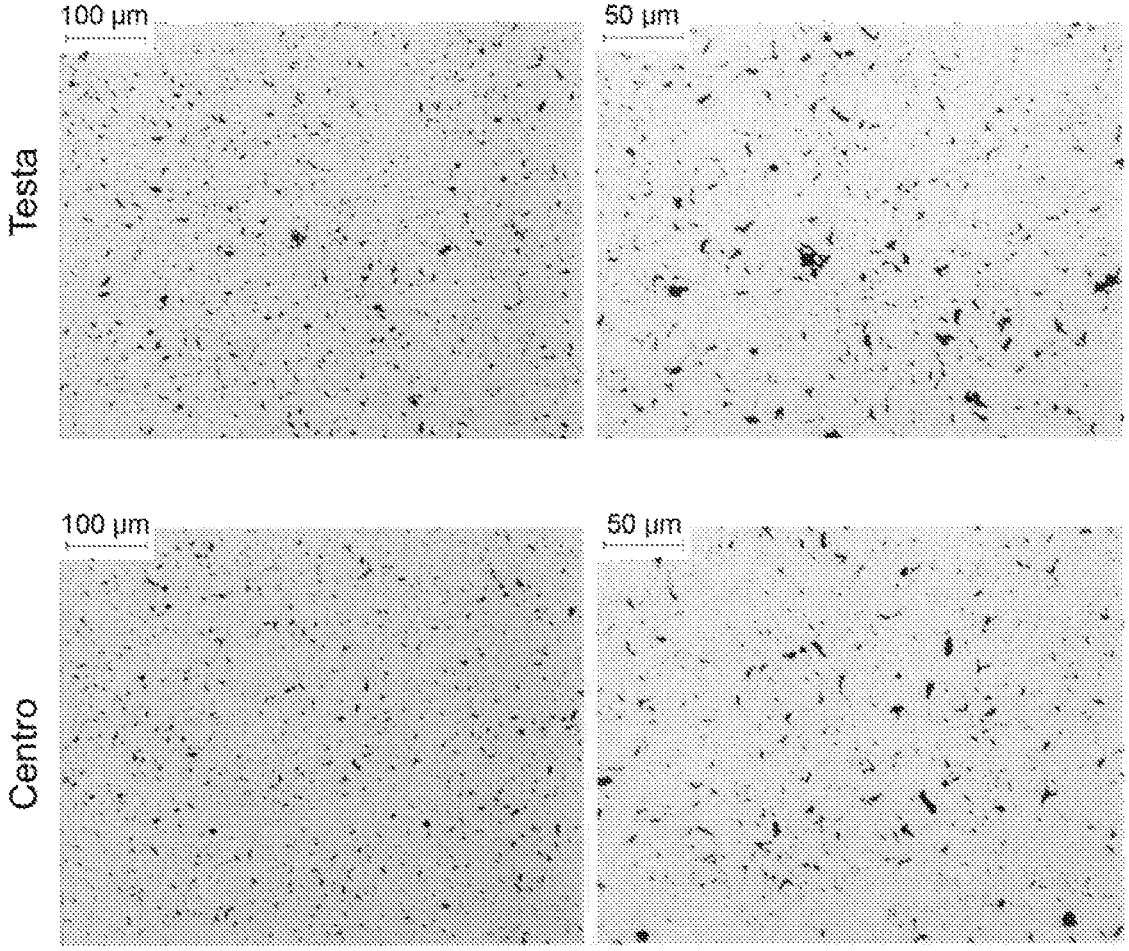

FIGS. 1 and 2 show micro-structures, at two different enlargements, of bars B1 and B2, characterized in head and center, in cross section.

Traction tests have indicated for both bars a Rp0.2% of about 170 MPa, a Rm of about 370 MPa and an A % of 23%.

Such tests indicate that the bars thus obtained have mechanical and micro-structural features which are mutually similar and practically identical to those of bars obtained by means of traditional cycle.

Embodiment of the Invention

According to the invention, the billet is obtained by extrusion, either direct or inverted, of a mixture of lead-free or low lead content brass chips and graphite powder.

The mixture is preheated or, in a variant embodiment, is heated during the extrusion.

Figure 3:
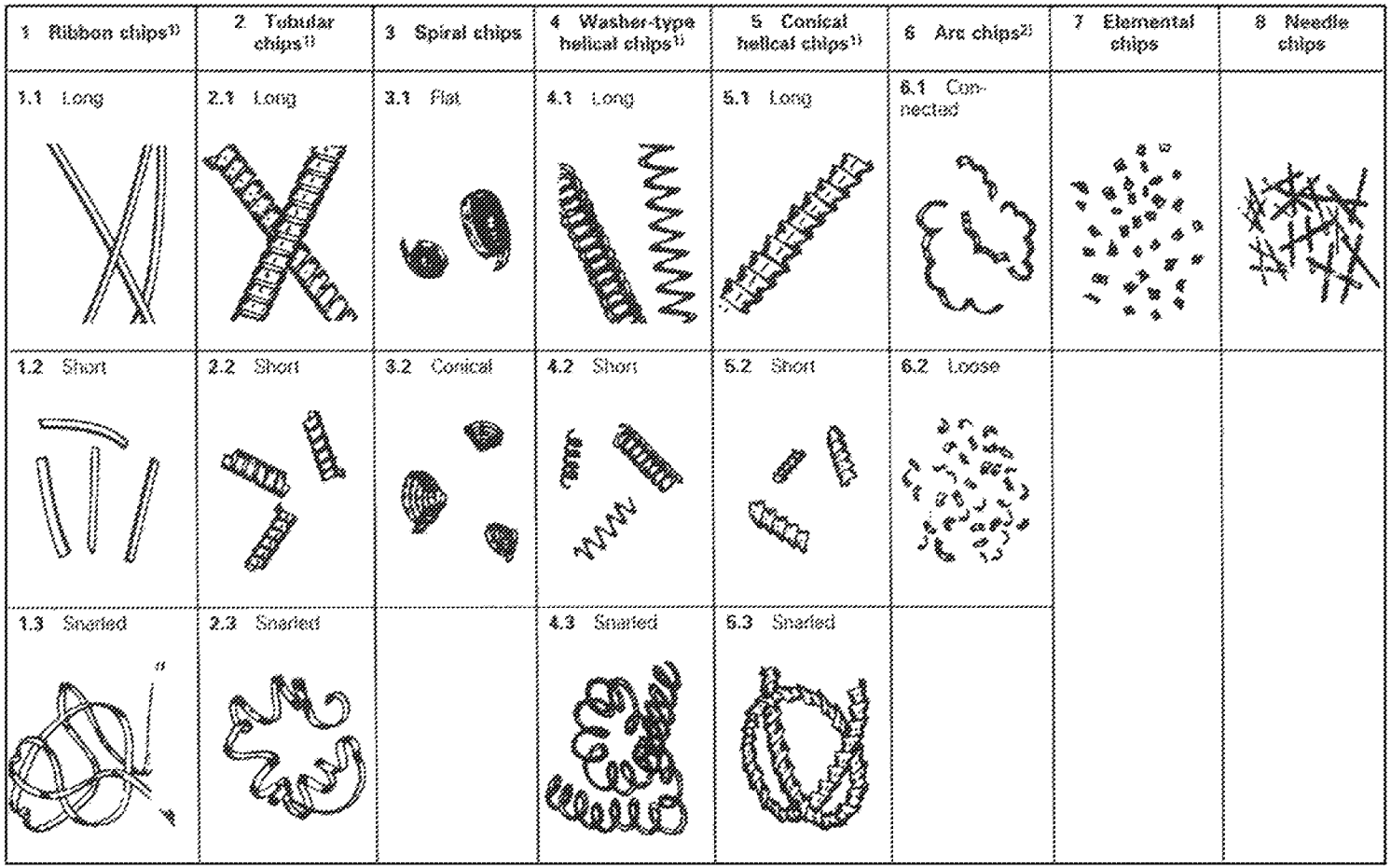
FIG. 3 is a table taken from international standard ISO3685, which illustrates different chip forms.

The word "chip" identifies a more or less thin strip of material, generally snarled. For example, the chip has the forms shown in table G.1 of International Standard ISO3685 (FIG. 3).

The brass chips derive from the mechanical machining by chip removal performed on the semi-finished products made of lead-free or low lead content brass.

According to a variant embodiment, the brass chips are fragmented by grinding, so that the billet is obtained by means of extrusion, either direct or inverted, of a mixture of fragmented, lead-free or low lead content brass chips and graphite powder.

The chips are fragmented by grinding, e.g. in mills, with separation of the fraction having grain size smaller than a predetermined grain size, e.g. <0.5 mm (brass fragments), and recirculation of the remaining fraction.

Successively, the brass fragments are mixed with graphite powder (e.g. average grain size of 20 μm), e.g. 1% w/w, e.g. in revolving mixers, to obtain a uniform mixture.

Innovatively, the process according to the present invention is extremely advantageous from the industrial point of view because it envisages the relatively simple management of powders and chips and the use of the existing extrusion presses.

In particular, the use of chips advantageously allows to perform the mechanical manufacturing by chipping in a remote plant and the separation of the fragments and the extrusion in a main plant. The chip is transported from the remote plant to the main plant without incurring in the problems of powders transporting.

The invention claimed is:

1. A method for obtaining a lead-free or low lead content brass billet, comprising the steps of:

performing mechanical machining by chip removal on a semi-finished product made of lead-free or low lead content brass, obtaining a predetermined amount of chips, wherein the chips comprise stretched or snarled strips of material, and wherein the step of mechanical machining by chip removal is performed at a remote plant;

preparing a predetermined amount of graphite powder, having a predetermined average grain size;

transporting the predetermined amount of chips to a main plant;

fragmenting the predetermined amount of chips by grinding, and obtaining brass fragments;

separating brass fragments having grain size smaller than a predetermined grain size in the amount of chips to obtain a brass powder;

mixing the brass powder with graphite powder, obtaining a brass-graphite mixed powder;

collecting the mixed powder in a copper cylindrical container, adding inert gas to the copper cylindrical container, and sealing the copper cylindrical container;

heating the copper cylindrical container and the brass-graphite mixed powder, obtaining a heated copper cylindrical container and mixed powder;

subjecting the heated copper cylindrical container and mixed powder to an extrusion, obtaining a composite billet containing material of the copper cylindrical container on an exterior surface;

peeling the copper cylindrical container to eliminate the material of the copper cylindrical container from the composite billet and obtaining the lead-free or low lead content brass billet;

wherein the fragmenting the predetermined amount of chips, the separating the brass fragments, and the subjecting the heated copper cylindrical container and mixed powder to an extrusion are performed in the main plant.

2. A method according to claim 1, wherein the predetermined amount of chips is ground, and brass fragments having a grain size smaller than 0.5 millimeters, are separated.

3. A method according to claim 1, wherein the mixed powder comprises graphite powder of 0.5%-1% by weight.

4. A method according to claim 2, wherein the copper cylindrical container and mixed powder is heated to a temperature between 600-780° C.

5. A method according to claim 1, wherein the extrusion is direct.

6. A method according to claim 1, wherein the extrusion is inverted.

7. A lead-free or low lead content brass billet made according to the method of claim 1.

* * * * *